US005333329A

United States Patent [19]

Hong

[11] Patent Number: 5,333,329

[45] Date of Patent: Aug. 2, 1994

[54] RATCHET SYSTEM FOR MOTORCYCLE HELMET SHIELD

[75] Inventor: Scott S. Hong, Cerritos, Calif.

[73] Assignee: Hong Jin Crown America, Santa Fe Springs, Calif.

[21] Appl. No.: 1,313

[22] Filed: Jan. 6, 1993

[51] Int. Cl.[5] ..... A42B 3/02

[52] U.S. Cl. ..... 2/424

[58] Field of Search ..... 2/424, 425, 410, 9, 2/10, 6.3, 6.4, 6.5, 15

[56] References Cited

U.S. PATENT DOCUMENTS

| | | | |
|---|---|---|---|
| 3,756,692 | 9/1973 | Scott | 2/431 |
| 3,781,914 | 1/1974 | Ramsay | 2/10 |
| 4,176,410 | 12/1979 | Matthias | 2/436 |
| 4,748,696 | 6/1988 | Fohl | 2/10 |
| 5,005,221 | 4/1991 | Chen | 2/425 |
| 5,018,223 | 5/1991 | Dawson et al. | 2/441 |
| 5,091,997 | 3/1992 | Foehl | 2/424 |
| 5,095,551 | 3/1992 | Chin | 2/424 |
| 5,165,117 | 11/1992 | Kamata | 2/424 |
| 5,185,889 | 2/1993 | Kamata | 2/424 |

FOREIGN PATENT DOCUMENTS

| | | | |
|---|---|---|---|
| 223139 | 5/1987 | European Pat. Off. | 2/424 |
| 2024000 | 1/1980 | United Kingdom | 2/424 |

OTHER PUBLICATIONS

Enlargement of sticker that was placed on Shoei Face Shield Model Number C-10 as Sold With Shoei Helmet Model Number RF-200. Printing date unknown.

From Shoei's RF-200 Instructions For Use, pp. 9 and 10. This is the Instruction Manual for a Shoei Helmet That Uses the C-10 Ratchet Collar Face Shield, Printed in Approximately 1989.

Components of Shoei Face Shield Model C-10.

From Nolan's Instructions: Disassembly-Assembly of N25 Visor and Spare Parts, p. 4. Appears to have been printed in 1992.

Nolan Face Shield Model Number N39. View of an end portion of the shield.

AGV Face Shield Model Number KR2000. View of an end portion of the shield.

AGV Face Shield Models "Cobra," Alpha, and Sting. View of an end portion of the shield.

*Primary Examiner*—Clifford D. Crowder

*Assistant Examiner*—Michael A. Neas

*Attorney, Agent, or Firm*—Poms, Smith, Lande & Rose

[57] ABSTRACT

A ratchet system for a motorcycle or bicycle helmet shield has a one-piece face shield with end tabs having a ring of upraised teeth and additional radially extending teeth along a curved edge. The ratchet system also has a pair of helmet-mounted side plates, each having a leaf spring with a central point that engages in grooves between the radially extending teeth of the end tabs. The end tabs are pivotally mounted on the side plates. The ratchet system also has shield covers having a set of surface teeth to engage with grooves between the upraised teeth of the end tabs. The ratchet system may also include bolts for attaching the system to the helmet, for holding the covers against the end tabs, and for adjusting the ratcheting tension. A bicycle or motorcycle helmet face shield for protecting a bicycle or motorcycle rider's face from the sun includes a transparent body, an ultraviolet ray-filtering coating on a surface of the body, and a reflective coating on the same surface of the body. A method for manufacturing a face shield having a reflective, ultraviolet ray-filtering surface includes molding the shield in a steel mold, washing the shield in detergent, forming an ultraviolet ray-filtering coating, washing the shield with freon, and bombarding a surface of the shield with heated tinting particles in a vacuum chamber.

8 Claims, 2 Drawing Sheets

FIG. 1
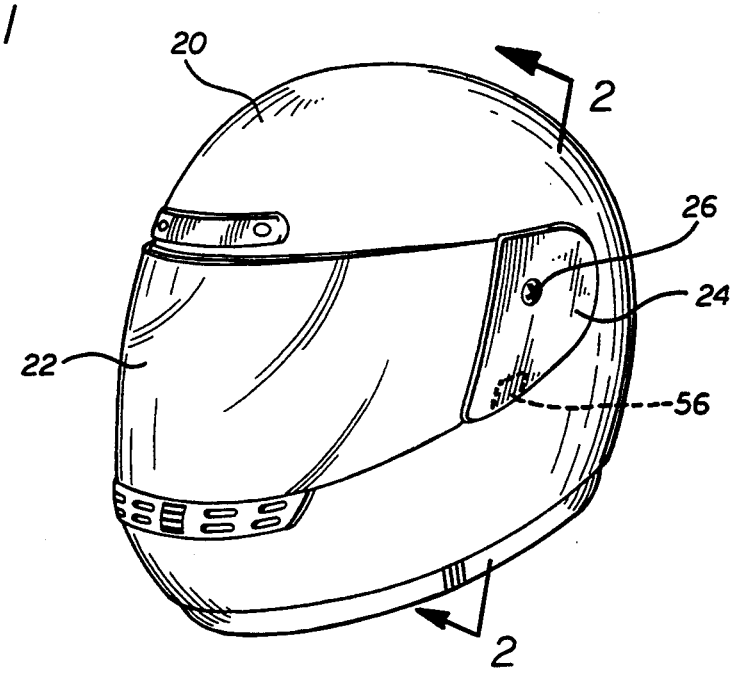
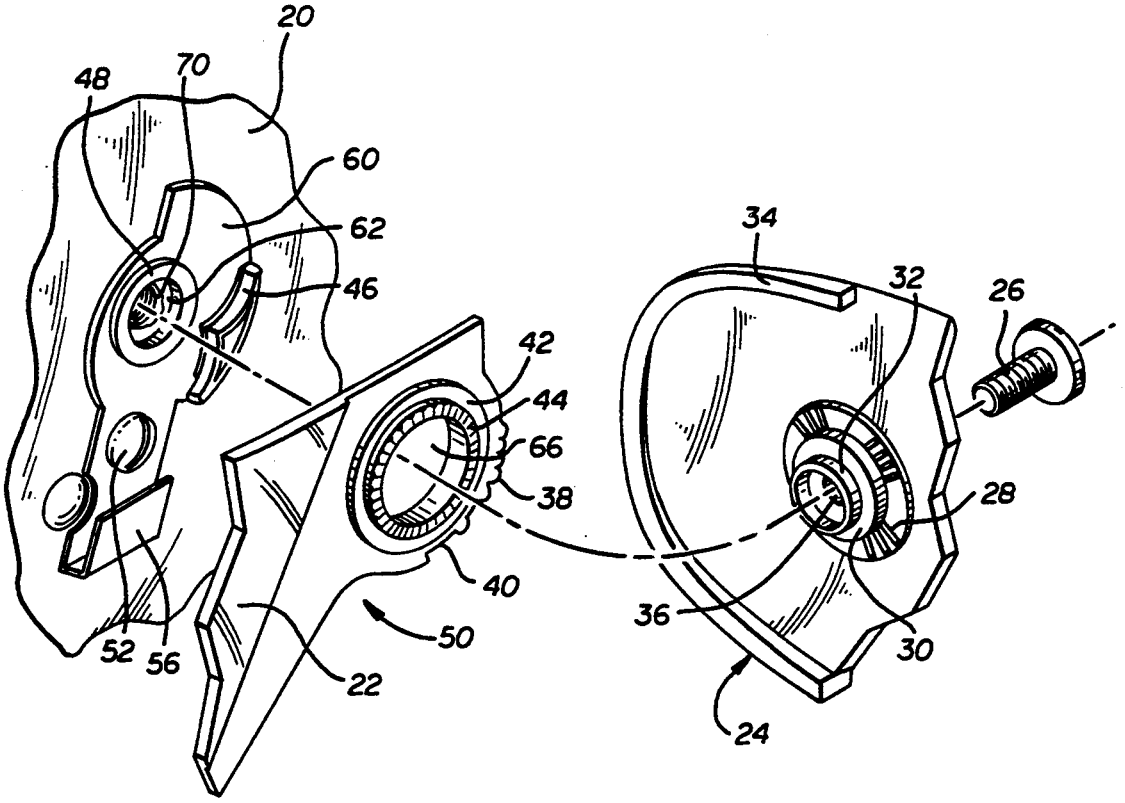
FIG. 2

RATCHET SYSTEM FOR MOTORCYCLE HELMET SHIELD

FIELD OF THE INVENTION

This invention relates to ratchet systems, light-filtering coatings, and tinting processes for motorcycle and bicycle helmet shields, and more particularly to a novel face shield for a motorcycle or bicycle helmet having a ratchet system which enables the user to position the shield in a plurality of incremental positions.

BACKGROUND OF THE INVENTION

Most motorcycle helmets and some bicycle helmets have a face shield to protect a rider's eyes from debris, bugs, and wind. The rider can typically raise the shield to a fully open position to increase helmet ventilation or to defog the interior surface of the shield. Unfortunately, the typical helmet does not allow the rider to partially open the shield without the oncoming wind blowing the shield into a different position.

U.S. Pat. No. 4,612,675 teaches a helmet with a shield that can be raised and locked into a single intermediate position. To release the shield from the intermediate position, the rider must disengage a control mechanism on the side of the helmet. There are at least two major problems with this type of helmet. First, the process of disengaging the control mechanism is both awkward and dangerous when done while riding. Second, with only one intermediate shield position, the rider cannot adjust the volume of air flowing into the helmet. At high speeds, the rider may only need to open the shield a small amount in order to adequately defog the shield and increase helmet ventilation. On the other hand, at lower speeds the rider may need to open the shield almost to the fully open position to get adequate air flow.

Separate problems arise with the shield itself, which is typically mounted onto a frame that is attached to the helmet. First, the dynamic, high-stress environment of motorcycle and bicycle riding can cause the shield to vibrate free from or to be jolted off of the shield frame. Second, although the shield must be occasionally replaced because of debris damage, replacing a frame-mounted shield is difficult and time consuming. An additional problem is that the shield frame increases the overall weight of the helmet, thereby increasing the load that the rider's head must bear.

A further problem arises with the light-filtering qualities of the typical face shield. In the early days of motorcycles, a rider would wear goggles in order to protect his or her eyes from wind, insects, and debris. However, goggles did nothing to protect the rider's face from extended exposure to sunlight. Many riders suffered sun burn on their cheeks, nose, and forehead, and ran the risk of contracting skin cancer.

As motorcycle riding became more advanced, riders began wearing helmets having a face shield. Although such face shields protected the rider from wind, insects, and debris, the shields did not protect the rider's face from the sunlight. Overexposure to sunlight has been a particular problem for touring riders, who can be exposed to the sun for eight or more hours per day. Some riders have worn sunglasses underneath their helmet in order to protect their eyes, but the glasses have tended to fog-up and to slip around on the rider's face in the warm, humid atmosphere inside the helmet. Furthermore, the sunglasses have not protected the rider's entire face from the sun. Likewise, some riders have experimented with wearing ski goggles underneath their helmets. However, ski goggles become quite uncomfortable and also fail to protect a rider's entire face.

In view of the positioning problems of the typical helmet shield, the problems associated with frame-mounted helmet shields, and the light-filtering problems with known shields, the present invention addresses itself to a one-piece helmet face shield with a bi-directional ratchet positioning system and a face shield that filters ultraviolet rays.

SUMMARY OF THE INVENTION

There are three principal objects of the present invention. First, it is an object of the present invention to provide a one-piece face shield for a motorcycle or bicycle helmet that does not require a face shield frame and which a user can easily replace. Second, it is an object of the present invention to provide a bi-directional ratchet face shield positioning system for a motorcycle or bicycle helmet which permits a rider to incrementally raise or lower the face shield and which will prevent wind or shocks from changing the position of the face shield. Additionally, it is an object of the present invention to provide a face shield that will protect a rider's eyes and face from the sun, and to provide a method to manufacture such a face shield.

Generally stated, a one-piece face shield that satisfies the first object includes an arched middle portion and end tabs on either side of the middle portion. Each end tab has a ring of upraised teeth. Each end tab also has additional teeth that extend radially from a curved edge of the tab. Both sets of teeth interconnect with a ratchet system that is attached to the helmet.

A preferred embodiment of a ratchet system that satisfies the second of the foregoing objects includes a pair of side plates mounted on the outer shell of the helmet, the end tabs of the aforementioned one-piece face shield, and shield covers to fit over each end tab. The end tabs are pivotally mounted on the side plates, which have a leaf spring with a point that fits in between the notches of the radially extending teeth of the curved edge of the end tabs. There is a set of teeth on a surface of the shield covers to engage with the grooves between the upraised teeth on the end tabs. The ratchet system may also include bolts for attaching the system to the helmet, for holding the covers against the end tabs, and for adjusting the ratcheting tension, which determines the amount of force necessary to raise or lower the face shield.

A preferred embodiment of a face shield that satisfies the third of the foregoing objects includes a transparent body, an ultraviolet ray-filtering coating on a surface of the body, and a reflective coating on a surface of the body. The reflective coating may comprise particles of silicon dioxide and chromium to form a silver coating. The reflective coating may further comprise particles of titanium dioxide to form a colored reflective coating.

A preferred method of manufacturing a face shield having a reflective, ultraviolet ray-filtering surface includes several steps. First, the face shield is molded in a steel mold, after which the shield is washed in a detergent. Then the face shield is soaked in a liquid containing ultraviolet ray-filtering chemicals in order to form a coating that filters ultraviolet rays. After the face shield is washed with freon, the shield is placed in a vacuum chamber, where a surface of the face shield is bombarded with heated tinting particles to cause tinting.

As is apparent from the foregoing description, the one-piece face shield, the hi-directional ratchet system, the face shield having an ultraviolet ray-filtering coating, and the method for manufacturing the face shield readily satisfy the objects of the invention. The one-piece face shield attaches to the helmet without a face shield frame, allowing a user to easily replace the face shield when necessary. The bi-directional ratchet system permits a user to incrementally raise or lower the face shield, but prevents the wind or shocks from subsequently changing the shield position. The face shield with an ultraviolet ray-filtering coating protects a rider's entire face from the sun. Additionally, the method of manufacturing the face shield provides the shield with both surface tinting and a hard Ultraviolet ray-filtering coating, thereby eliminating the need for a rider to wear sunglasses.

Other objects, features, and advantages of the invention will become apparent from a consideration of the following detailed description and the accompanying drawings.

BRIEF DESCRIPTION OF THE DRAWINGS

FIG. 1 is a perspective view of an exemplary motorcycle or bicycle helmet with a one-piece face shield and ratchet system;

FIG. 2 is an exploded view taken at Section 2—2 of FIG. 1 illustrating the components of an embodiment of the ratchet system, which includes the side plate, an end tab of the face shield, and a side cover;

DETAILED DESCRIPTION OF THE PREFERRED EMBODIMENT

Figure 3:
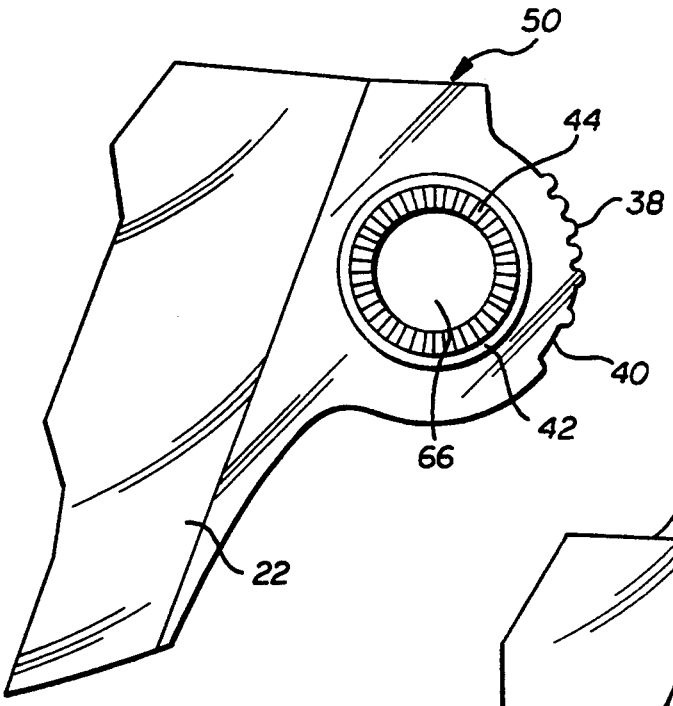
FIG. 3 is a view of the end tab of FIG. 2 showing more particularly both the upraised teeth and the radially extending teeth.

Referring more particularly to the drawings, FIG. 1 illustrates a present preferred embodiment of a motorcycle or bicycle helmet that includes a face shield ratchet system. The basic structure of the helmet is the outer shell 20, which is typically made of fiberglass. The helmet includes a one-piece face shield 22 which protects the rider's eyes from debris, bugs, and wind. Face shield 22 may be entirely transparent, or may have a coating which filters out some or all ultra violet rays. Face shield 22 may also have a reflective, colored tinting. FIG. 1 further shows one of the two shield covers 24 which cover the end tabs 50 of face shield 22, which is shown in FIG. 2. Bolt 26 serves to hold shield cover 24 against end tab 50, and to attach shield cover 24 to the helmet outer shell 20.

FIG. 2 illustrates the various components that comprise the face shield ratchet system. Bolt 52 attaches side plates 60 to outer shell 20. The principle features of side plates 60 are a pointed leaf spring 46 and a shield cover tab 56. Side plate 60 also includes a projecting mounting rim 48, which serves as an axis of rotation for end tab 50.

Face shield end tabs 50 function as integral parts of the ratcheting system. Each end tab 50 has an aperture 66 surrounded by a ring of upraised teeth 44. The ring of upraised teeth 44 is itself surrounded by flange 42 for structural strength. End tab 50 has a second set of teeth 38 extending radially from curve edge 64. The teeth may be unevenly spaced or may have a variety of heights in order to vary the difficulty and distance of rotation. At one end of the set of radially extending teeth 38 is a tooth free indentation 40 which engages with pointed leaf spring 46 in the basic, fully lowered position of the face shield as the shield appears in FIG. 1.

Shield cover 24 includes three basic structures. First, in the interior surface are sets of shield cover teeth 28 on the interior surface which are designed to engage with the grooves between the upraised teeth 44 on end tabs 50. Shield cover 24 also includes flange 30, which serves as part of the axis about which face shield 22 rotates, and projecting rim 32 which fits inside of well 62 of side plate 60 when the ratchet system is fully assembled and operational. Second, shield cover 24 includes projecting rim 34 around the edge of the shield cover which prevents motion of shield cover 24 within a recess of the outer shell in which the ratchet system may be mounted. Additionally, shield cover 24 includes bolt aperture 36 through which bolt 26 passes when the ratchet system is assembled.

The three main components of the ratchet system are held together in two ways. First, end tabs 50 are mounted onto projecting rims 48 of side plates 60. Each pointed leaf spring 46 interconnects with one groove of radially extending teeth 38 of face shield end tabs 50. Shield cover 24 fits over face shield end tabs 50 such that flange 30 meets with the interior rim of the ring of upraised teeth 44 and projecting rim 32 mates with the interior of side plate projecting rim 48. Shield cover teeth 28 then mesh in grooves between upraised teeth 44 on end tab 50. Bolt 26 passes through bolt aperture 36, through end tab aperture 66 and into nut 70, which is embedded in outer shell 20 underneath side plate 60. A user may tighten bolt 26 in order to increase the engagement pressure between shield cover teeth 28 and the grooves of upraised teeth 44, thereby increasing the ratcheting tension, which refers to the force necessary to raise or lower the face shield.

Figure 4:
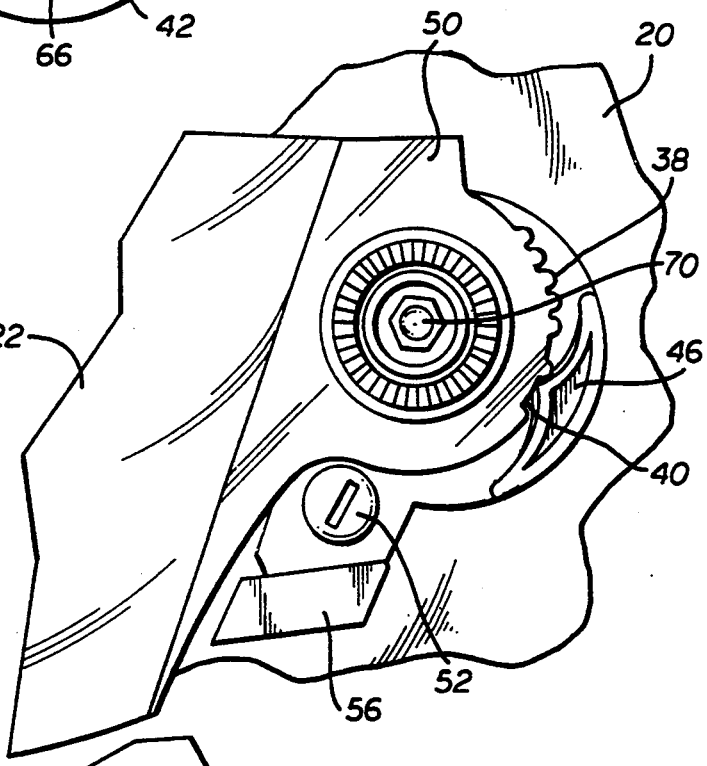
FIG. 4 is a view of the ratchet system as it appears beneath the shield cover when the face shield is in a fully lowered position, as in FIG. 1.
Figure 5:
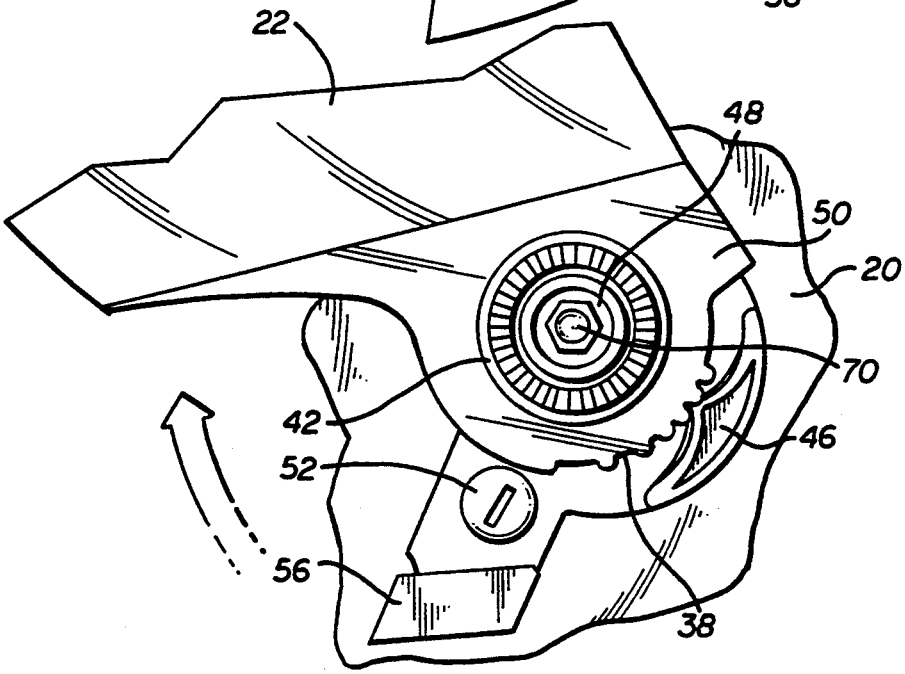
FIG. 5 is a view of the ratchet system as it appears underneath the shield cover when the face shield is partially raised.

FIG. 4 is a side view of an end tab 50 mounted onto side plate projecting rim 48 with the point of leaf spring 46 engaged with tooth-free indentation 40 and against one of the radially extending teeth 38. This corresponds to the fully lowered position of the face shield. To raise the face shield to a position as in FIG. 5, the user rotates the shield upward, thereby causing the point of leaf spring 46 to come to rest in a groove between radially extending teeth 38.

It should be noted that the present helmet ratchet system allows the user to quickly and easily replace a face shield 22. The user need only loosen and remove bolts 26, disengage shield covers 24 from shield cover tabs 56, and simply pull end tabs 50 free from side plate 60. This feature is especially useful because face shields are frequently damaged by flying particles, which may pit the exterior surface of the face shield or cause surface scratches which blur a rider's vision.

The surface of a face shield may include a hard ultraviolet ray-filtering coating to protect a rider's eyes and face from the sun. The face shield typically has a main body of molded poly carbonate resin, and the hard ultraviolet ray-filtering coating is typically formed in a liquid bath which includes the chemicals described in the method below. The surface of a face shield may also include a silver reflective coating comprising particles of silicon dioxide and chromium. The reflective coating may also include particles of titanium dioxide to give the coating a gold, green or blue color.

A method to manufacture reflective, ultraviolet ray-filtering face shields for motorcycle or bicycle helmets includes the following steps. First, the shields are molded in a steel mold. The shields are removed from the mold and are washed in detergent by an ultrasonic washer for 40 minutes. The washed shields are then soaked in a liquid containing chemicals to create a hard, ultraviolet ray-intercepting coating that filters out some or all of incoming ultraviolet rays. These chemicals may include dipentaerithritol hexacrylate, highly alkoxylated triacrylate, 1.6 - hexandiol diacrylate, cyclohexyl acrylate, hydroxy ethoxy ethoxy ethyl acrylate, acetophenone diethyl ketal, and dimethyl polysiloxane poly ether. Once the shields have been provided with the hard UV coating, the shields are washed in freon with an ultrasonic washer for 10 minutes. After that, the shields are placed into a vacuum machine having a chamber and an electronic ray gun.

The ray gun first generates tiny particles of heated silicon dioxide and shoots those particles in a ray onto the surface of the face shields. The ray gun next generates tiny particles of heated chromium and shoots those particles in a ray onto the surface of the face shield, to form a reflective silver surface. If a colored, reflective surface is desired, the ray gun then generates tiny particles of burning titanium dioxide and shoots those particles onto the surface of the face shields. Various shades of gold, green, and blue can be produced by adjusting the period of time with which the surface is bombarded with titanium dioxide. It should be noted that the temperature inside the vacuum chamber is between about 60° C. and about 90° C. when the shields are being tinted. Finally, the finished face shield is exposed to water bubbles or moisture in order to give the surface of the shield anti-absorption properties.

In conclusion, it is to be understood that the foregoing detailed description and the accompanying drawings relate to preferred embodiments of the invention. Various changes and modifications may be made without departing from the spirit and scope of the invention. Thus, by way of example and not of limitation, face shield and tab apertures 66 might be lined with a ball bearing mechanism for smooth rotation. Side plates 60 could be provided with multiple shield cover tabs. Various types of pointed springs may be used to perform the same function as pointed leaf spring 42. There are a variety of alternatives to bolt 26, including screws, pins, and the like, all of which serve the functions of connecting the shield covers to the outer shell and holding the shield covers against the end tabs. End tabs 50 could have a second ring of upraised teeth to mesh with a set of teeth provided on side plate 60. A threaded shaft may be used rather than nut 70. Ultraviolet ray-filtering chemicals may be provided as an integral part of the face shield body itself, rather than as a coating on a surface of the shield. The method for manufacturing reflective, ultraviolet ray-filtering face shields is not limited to manufacturing face shields for use with helmets having a face shield ratchet system, but may be used to manufacture a variety of different face shields. Additionally, particles other than silicon dioxide, chromium, and titanium dioxide may be used to create the tinted, reflective coating.

Accordingly, the present invention is not limited to the specific embodiment shown in the drawings and described in the detailed description.

What is claimed is:

1. A bi-directional ratchet system for a motorcycle or bicycle helmet comprising:

an outer shell having a front opening for forward viewing;

a face shield; and bi-directional ratchet means for incrementally raising the face shield when it is in a lowered position over the front opening, and for incrementally lowering the face shield over the front opening when the shield is in a raised position; wherein:

the face shield further comprises an arched middle portion and end tabs on either side of the middle portion; and the means for incrementally raising and lowering the face shield comprises:

a. side plates which are fixedly mounted to the outer shell, the end tabs of the face shield being rotatably mounted onto the side plates;

b. shield tab covers which cover the end tabs and which are attached to the outer shell;

c. a projecting ring of upraised teeth disposed at each of said end tabs;

d. teeth disposed within said shield tab covers which interconnect with grooves of the projecting rings of upraised teeth;

e. additional teeth extending radially outwardly from an edge of the end tabs; and f. a leaf spring having a central point that interconnects with the grooves between the radially extending teeth of the end tabs.

2. The face shield ratchet system as defined in claim 1, wherein the hi-directional ratchet means further comprises:

connecting means for attaching the shield covers to the outer shell, for holding the shield covers against the end tabs so that the teeth of the shield covers interconnect with grooves of the projecting ring of upraised teeth, and for adjusting ratchet tension of the ratchet means.

3. The face shield ratchet system as defined in claim 2, wherein said connecting means comprises:

a. threaded shafts embedded in said outer shell; and b. a pair of bolts to engage with said threaded shafts.

4. The face shield ratchet system of claim 3, wherein each of the side plates include a U-shaped shield cover retaining tab and the shield covers include recesses, such that the shield cover retaining tabs engage with the recesses in order to hold the shield covers against the end tabs, the side plates, and the outer shell.

5. A bi-directional ratchet system for incrementally raising and lowering a face shield on a motorcycle or bicycle helmet, said system comprising:

an outer shell having a front opening for forward viewing;

a unimolded, one-piece face shield having an arched middle portion and end tabs on either side of the middle portion, each of the ends tabs having a central aperture, a rim around the aperture having upraised teeth, and additional teeth extending radially outwardly from an edge of the end tabs;

a pair of side plated mounted on the outer shell, the side plates having a leaf spring having a central point that interconnects with grooves between the radially extending teeth on the end portions of the face shield, an aperture, and a projecting rim forming the perimeter of the aperture to mate with the rim of the aperture of the end tabs for rotatably mounting the shield onto the side plates;

shield covers to fit over each end portion of the face shield, the shield covers including meshing teeth to engage with grooves between the upraised teeth of the face shield; and means for attaching each of the shield covers to the outer shell and for holding the shield covers against the end tabs, whereby the face shield may be incrementally raised and lowered over the front opening.

6. The ratchet system as defined in claim 5, wherein the means for attaching each of the shield covers to the outer shell and for holding the shield covers against the end tabs comprises threads in the outer shell and bolts that can be loosened or tightened to adjust ratcheting tension.

7. The ratchet system as defined in claim 5, wherein each of the side plates further comprises a U-shaped shield cover tab and wherein each of the shield covers further comprises a recess, and the means for attaching the shield covers to the outer shell and for holding the shield covers against the end tabs further comprises engaging the recesses in the U-shaped shield cover tabs.

8. The ratchet system as defined in claim 5, wherein the outer shell includes recesses which have a shape corresponding to that of the shield covers and into which the ratchet system is mounted.

* * * * *